United States Patent [19]

Sato et al.

[11] 4,161,156

[45] Jul. 17, 1979

[54] POWER PROPELLED BOAT WITH IMPROVED ELECTRICAL CONNECTOR

[75] Inventors: Masato Sato, Akashi; Keiichi Nakamizo, Himeji, both of Japan

[73] Assignee: Kawasaki Jukogyo Kabushiki Kaisha, Kobe, Japan

[21] Appl. No.: 825,032

[22] Filed: Aug. 16, 1977

[30] Foreign Application Priority Data

Aug. 19, 1976 [JP] Japan ..... 51-111513[U]

[51] Int. Cl.[2] ..... B63B 35/72

[52] U.S. Cl. ..... 115/76; 115/18 E; 115/70; 174/65 SS; 339/94 A; 339/128

[58] Field of Search ..... 115/70, 76, 18 E; 339/94 R, 94 A, 128, 91 R; 174/65 SS; 16/2

[56] References Cited

U.S. PATENT DOCUMENTS

| | | | |
|---|---|---|---|
| 3,187,292 | 6/1965 | Small et al. | 339/94 A |
| 3,475,718 | 10/1969 | Hartz et al. | 339/128 X |
| 3,623,447 | 11/1971 | Jacobson | 115/70 |
| 3,826,220 | 7/1974 | Jacobson | 115/70 |

*Primary Examiner*—Trygve M. Blix
*Assistant Examiner*—Sherman D. Basinger
*Attorney, Agent, or Firm*—Fleit & Jacobson

[57] ABSTRACT

Power propelled boat including a boat hull and an engine for providing a propulsive force. The engine has one or more electric components such as ignition coils, voltage regulators and capacitor discharge ignition units which are housed in a casing mounted on the boat hull. The components are connected with functionally associated electric parts such as ignition plugs, generators and magnetos through wires which are connected with the components through a specially designed connector.

6 Claims, 7 Drawing Figures

POWER PROPELLED BOAT WITH IMPROVED ELECTRICAL CONNECTOR

The present invention relates to marine engines. More specifically, the present invention pertains to arrangements of electric components for marine engines.

In comparatively small power propelled boats such as those equipped with outboard engines, power propelled water ski and the like, particular care must be made for ensuring water-tight seal on electric components such as ignition coils, voltage regulators, capacitor discharge ignition units and so on. Conventionally, such electric components have been mounted on or in the vicinity of the engine housings and often subjected to serious sealing problems.

The present invention has therefore an object to solve the aforementioned sealing problems in marine engines.

Another object of the present invention is to provide arrangements of electric components for marine engines, which are convenient for ready access thereto.

According to the present invention, the above and other objects can be accomplished by a boat having a boat hull, an engine unit having engine body means mounted on the boat hull for providing propulsive force, and at least one electric component for the engine unit which is positioned in a water-tight casing mounted on the boat hull, said engine unit having at least one electric part which is functionally associated with said electric component and mounted on said engine body, said electric part being connected with said component through wire means having one end connected with said electric part and the other end through removable connector means with said electric component, said connector means including disconnectable jack and receptacle means and water-tight cover means encircling said jack and receptacle means.

According to a preferable aspect of the present invention, the wire means is formed with loop means in said cover means so that excess length of wire means is stored in said cover means. The wire means may preferably be provided with resilient grommet means which is compressed by nut means so as to engage with said cover means and said wire means for providing water-tightness. Similar grommet means may preferably be provided at the other end of the wire means.

The above and other objects and features of the present invention will become apparent from the following descriptions of preferred embodiments taking reference to the accompanying drawings, in which.

Figure 1:
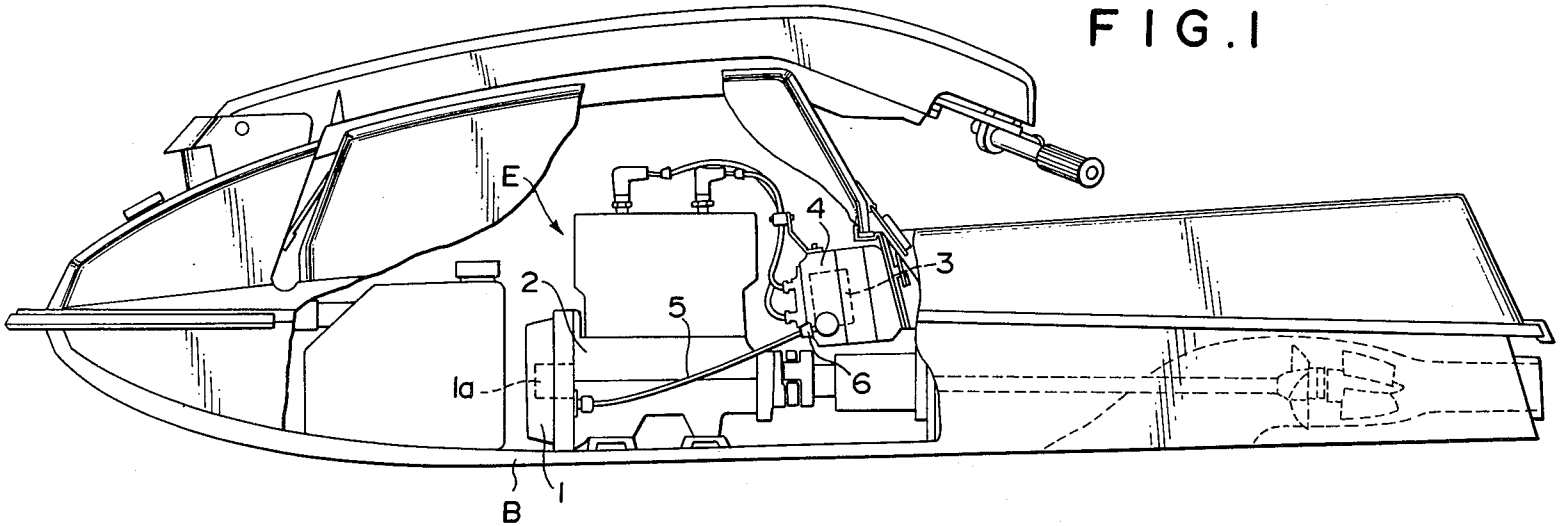
FIG. 1 is a partially cut-away side view of a water jet ski embodying the feature of the present invention.

Referring now to the drawings, particularly to FIG. 1, there is shown a general arrangement of the engine and its electric component. The engine E has a body 2 mounted on a boat hull B in a manner conventional in the art. On the body 2, there is mounted an accessory housing 1 in which one or more engine driven electric accessories 1*a* are positioned. Such accessories may include an engine starter-generator and a magneto for a capacitor discharge ignition (CDI) unit. On the boat hull B, there is mounted a water-tight casing 4 and one or more electric components 3 are disposed in the casing 4. Such components 3 may include an ignition coil, a voltage regulator and a CDI unit. The accessory 1*a* is connected with the component 3 through wires 5 which are connected at one end with the accessory 1*a* and at the other end through a connector assembly 6 with the component 3.

Figure 2:
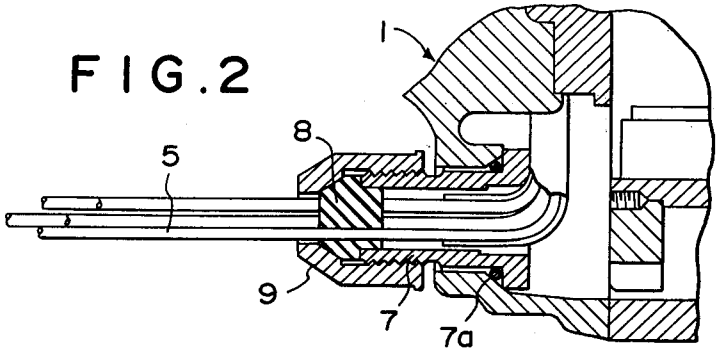
FIG. 2 is a fragmentary sectional view showing one example of grommet type water seal in accordance with the present invention.

Referring now to FIG. 2, the wires 5 leading from one or more accessories 1*a* in the housing 1 are passed through a tubular fitting 7 which is threadably engaged with the housing 1 with the intervention of an O-ring seal 7*a*. At the outer end of the fitting 7, there is fitting a grommet 8 which is made of a resilient material such as a rubber. The wires 5 are also passed through the grommet 8. An internally threaded cap 9 threadably engages the fitting 7 and compresses the grommet 8 therebetween. The arrangement is effective to ensure water tightness at the area where the wires are led out of the accessory housing 1.

In conventional arrangements, the wires 5 are simply inserted into passages in a grommet and sealing compound is applied in order to fill the gaps between the wires and the grommet passage walls. The aforementioned arrangement of the present invention is advantageous over the conventional arrangements in respect of the durability against vibrations and the reliability of the sealing structure.

It has also been proposed to provide a sealed tube in which the wires are passed. The above arrangement of the present invention is advantageous over this type of prior art in respect of manufacturing and assembling costs.

Figure 3:
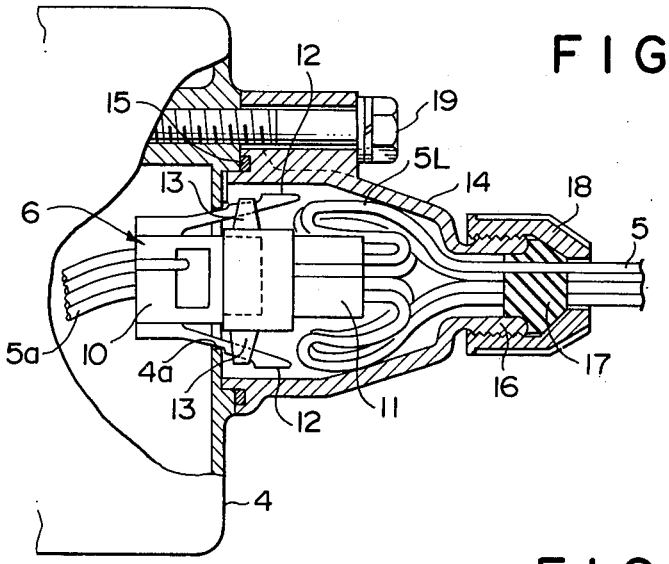
FIG. 3 is a fragmentary sectional view showing one example of the connection between the wire harness and the electric component.

Referring to FIG. 3, the connector assembly 6 comprises a jack assembly 10 and a receptacle assembly 11. The jack assembly 10 is connected with cables 5*a* from the electric components 3 and loosely mounted on the casing 4. More specifically, the jack assembly 10 is provided with a pair of serrated fingers 12 which are made of a resilient material and radially outwardly inclined as noted in FIG. 3. The jack assembly 10 is mounted on the casing 4 by inserting the fingers 12 into an opening 4*a* provided for the purpose in the casing 4.

The receptacle assembly 11 has a pair of hooks 13 which are adapted to engage the serrated fingers 12 when the receptacle assembly 11 has been engaged with the jack assembly 10.

The connector 6 further includes a cover 14 which is provided on the wires 5. The cover 14 carries a grommet 17 of a resilient material such as rubber at an end 16 and the wires 5 are passed through the grommet 17. A cap 18 threadably engages the end 16 on the cover 14 and compresses the grommet 17 to provide a water-tight seal. The cover 14 is secured by means of bolts 19 to the casing 4 with the intervention of a sealing ring 15 so as to cover the jack and receptacle assemblies 10 and 11. The wire 5 is looped in the cover 14 as shown by 5L in FIG. 3 so that the cover 14 can be moved adequately away from the casing 4 when it has been removed from the casing 4 so as to provide a room for accessing to the assemblies 10 and 11.

Figure 4:
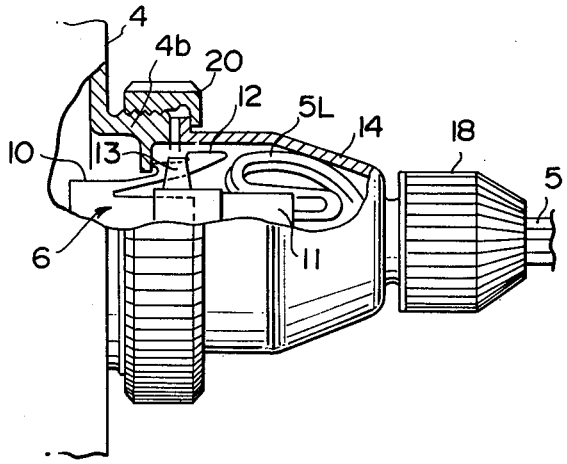
FIG. 4 is a partially cut-away fragmentary view showing another example of the connection between the wire harness and the electric component.

Referring to FIG. 4, there is shown a modified form of connector 6. In this example, the cover 14 is secured to the casing 4 not by means of bolts but by means of a ring nut 20 which is adapted to engage an externally threaded flange portion 4*b* on the casing 4.

Figure 5:
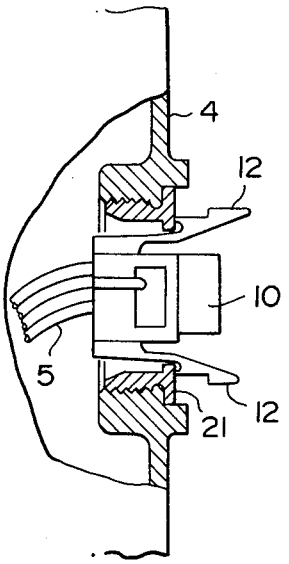
FIG. 5 is a fragmentary sectional view showing an alternative way of supporting the connector jack on the component casing.

FIG. 5 shows another way of mounting the jack assembly 10 on the casing 4. An annular member 21 is mounted on the casing 4 through threaded connection therebetween. The serrated fingers 12 on the jack assembly 10 are positioned in engagement with the member 21.

Figure 6:
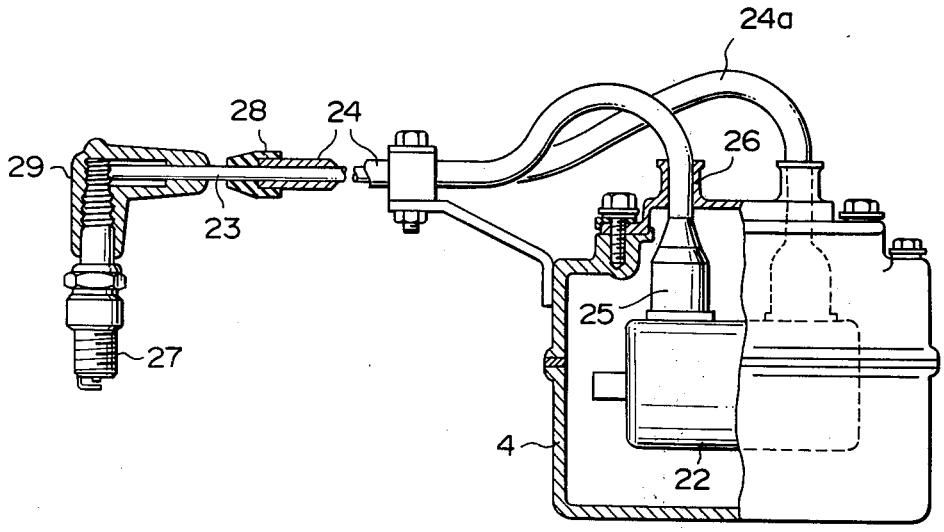
FIG. 6 shows an example of the arrangement of ignition coil in accordance with the present invention; and, FIG. 7 is a partially sectioned side view of the ignition coil shown in FIG. 6.
Figure 7:
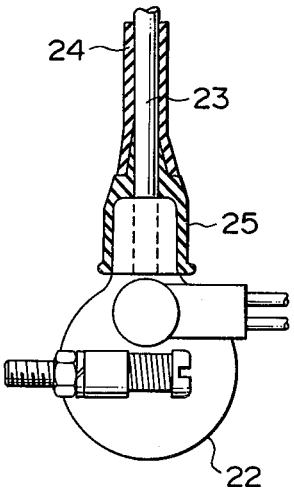

FIGS. 6 and 7 show an example of mounting an ignition coil in accordance with the present invention. An ignition coil 22 is mounted in the sealed casing 4 and connected with an ignition plug 27 through a high tension cord 23. Although not shown in the drawings, the cord 23 is connected to the ignition coil 22 through a known type of connector having a jack and a receptacle. The high tension cord 23 is covered by a sheath 24 which is secured at one end to the cord 23 by means of a resilient end cap 28. The other end of the sheath 24 is provided with an end cap 25 which is adapted to be fitted to the boss 22*a* on the ignition coil 22. The casing 4 has a closure 26 through which the high tension cord 23 is passed together with the sheath 24. The ignition plug 27 is provided with a rubber cap 29.

The sheath 24 is snugly fitted to the passage in the closure 26 so that an adequate water-tightness is maintained at this area. Further, the end cap 25 serves to seal the high tension cord 23 and the inside of the ignition coil against moisture. The end cap 28 also serves to prevent moisture from entering the interface between the high tension cord 23 and the sheath 24.

The invention has thus been shown and described with reference to specific embodiments, however, it should be noted that the invention is in no way limited to the details of the illustrated structures but changes and modifications may be made without departing from the scope of the appended claims.

We claim:

1. Power propelled boat comprising a boat hull, an engine unit having engine body means mounted on the boat hull for providing propulsive force, and at least one electric component for the engine unit which is positioned in a water-tight casing mounted on the boat hull, said engine unit having at least one electric part which is functionally associated with said electric component and mounted on said engine body, wire means for connecting said electric part with said electric component, said wire means having one end connected with said electric part and the other end adapted to be connected with said electric component, removable connector means for connecting said other end with said electric component, said removable connector means including disconnectable jack and receptacle means for releasably connecting said other end with said electric component, water-tight cover means releasably secured to the casing for encircling said jack and receptacle means, resilient grommet means for supporting said wire means passed therethrough, said grommet means being located on said cover means, and cap means adapted to be engaged with said cover means for compressing the grommet means so as to provide water-tight seal between the cover means, the grommet means, and the wire means, said wire means being formed with loop means in said cover means so that excess length of wire means is stored in said cover means.

2. Power propelled boat in accordance with claim 1 in which said cap means is a threaded cap which is adapted to threadably engage the cover means.

3. Power propelled boat in accordance with claim 1 in which one of the jack and receptacle means has serrated fingers and is loosely fitted to an opening in the casing, the other of the jack and receptacle means being provided with hooks for engaging said fingers when the connector is in connected position.

4. Power propelled boat in accordance with claim 3 in which said casing has an annular member fitted to said opening in the casing and said serrated fingers are loosely inserted into said annular member.

5. A mechanism for connecting an electric lead wire to a component of an electrical component of a power boat, the power boat having a boat hull, an engine unit having engine body means mounted on the boat hull for providing propulsive force, and at least one electric component for the engine unit which is positioned in a water-tight housing mounted on the boat hull, said engine unit having at least one electric part which is functionally associated with said electric component and mounted on said engine body, said mechanism comprising:

jack means positioned in an opening formed in said housing for receiving a lead wire connected to the electrical component;

receptacle means connected to an end of the electric lead wire and engageable with said jack means for connecting the electric lead wire and the lead wire connected to the electrical component;

cover means for encircling said receptable and said jack means, said cover means being adapted to be secured in a water-tight manner to the casing and having a portion thereof defining an opening for the passage of the electric lead wire;

compressible grommet means adapted to be positioned in and supported by the opening of said cover means for supporting the electric lead wire; and cap means adapted to be engaged with said cover means for compressing said compressible grommet means positioned in the opening of said cover means so as to provide a water-tight seal between said cover means, said grommet means, and the electric lead wire, said cover means defining an interior space sufficiently large to allow an accumulation of electric lead wire within said cover means so that said cover means can be removed from the housing without disengaging said cap means from said cover means.

6. Power propelled boat comprising a boat hull, an engine unit having engine body means mounted on the boat hull for providing propulsive force, and at least one electric component for the engine unit which is positioned in a water-tight casing mounted on the boat hull, said engine unit having at least one electric part which is functionally associated with said electric component and mounted on said engine body, wire means for connecting said electric part with said electric component, said wire means having one end connected with said electric part and the other end adapted to be connected with said electric component, removable connector means for connecting said other end with said electric component, said removable connector means including disconnectable jack and receptacle means for releasably connecting said other end with said electric component, water-tight cover means releasably secured to the casing for encircling said jack and receptacle means, resilient grommet means for supporting said wire means passed therethrough, said grommet means being located on said cover means, and cap means adapted to be engaged with said cover means for compressing the grommet means so as to provide water-tight seal between the cover means, the grommet means, and the wire means, one of said jack and receptacle means having serrated fingers and being loosely fitted to an opening in the casing, the other of said jack and receptacle means being provided with hooks for engaging said fingers when the connector means is in connected position.

* * * * *